US010800193B2

(12) United States Patent
Muramatsu et al.

(10) Patent No.: US 10,800,193 B2
(45) Date of Patent: Oct. 13, 2020

(54) NOZZLE OPERATING SITUATION CHECKING METHOD FOR INKJET PRINTING APPARATUS, AN INKJET PRINTING APPARATUS, AND A PROGRAM THEREOF

(71) Applicant: SCREEN HOLDINGS CO., LTD., Kyoto (JP)

(72) Inventors: Asuka Muramatsu, Kyoto (JP); Tomotaka Kato, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 3 days.

(21) Appl. No.: 16/279,130

(22) Filed: Feb. 19, 2019

(65) Prior Publication Data

US 2019/0263163 A1 Aug. 29, 2019

(30) Foreign Application Priority Data

Feb. 23, 2018 (JP) ..... 2018-030826

(51) Int. Cl.
*B41J 29/393* (2006.01)
*B41J 2/16* (2006.01)
*B41J 2/165* (2006.01)

(52) U.S. Cl.
CPC ..... *B41J 29/393* (2013.01); *B41J 2/16* (2013.01); *B41J 2/165* (2013.01)

(58) Field of Classification Search
CPC ... B41J 29/393; B41J 2/16; B41J 2/165; B41J 2/2142; B41J 2/16579
See application file for complete search history.

(56) References Cited

U.S. PATENT DOCUMENTS

2018/0272746 A1* 9/2018 Yokota ..... B41J 2/15

FOREIGN PATENT DOCUMENTS

JP 09-94950 A 4/1997

* cited by examiner

*Primary Examiner* — Bradley W Thies
(74) *Attorney, Agent, or Firm* — McDermott Will & Emery LLP

(57) ABSTRACT

A nozzle operating situation checking method for inkjet printing apparatus which perform printing by dispensing ink droplets from a printing head having a plurality of nozzles arranged in a transverse direction of a printing medium. The method includes the following steps: a step of printing a testing chart; a step of reading the testing chart downstream of the printing head; a step of extracting grid boxes; a step of deriving a standard width from width sizes; a step of detecting a box having a width size equal to or larger than a corrected standard width by comparing the width sizes of the respective boxes with the corrected standard width; and a step of determining that a missing nozzle exists upon detection of the box having a width size equal to or larger than the corrected standard width.

17 Claims, 11 Drawing Sheets

TRANSPORT DIRECTION X
TRANSVERSE DIRECTION Y
CP2a

CP2b

CP2c

CP2d

CP2e

CP2f
MISSING NOZZLE

NOZZLE OPERATING SITUATION CHECKING METHOD FOR INKJET PRINTING APPARATUS, AN INKJET PRINTING APPARATUS, AND A PROGRAM THEREOF

BACKGROUND OF THE INVENTION

(1) Field of the Invention

This invention relates to a nozzle operating situation checking method for inkjet printing apparatus which perform printing by dispensing ink droplets from a nozzle, an inkjet printing apparatus, and a program thereof.

(2) Description of the Related Art

In a conventional method of this type, a printing head having a plurality of nozzles arranged in a transverse direction of printing paper, which is perpendicular to a transport direction of the printing paper, is driven to dispense ink droplets to the printing paper and print a ladder-like testing chart including a plurality of linear charts on the printing paper. The method is used to determine missing nozzles based on presence or absence of linear patterns of the testing chart (see Japanese Unexamined Patent Publication H9-94950 (FIGS. 6 and 9), for example).

However, the conventional example with such a construction has the following problem.

The conventional method determines a missing nozzle by presence or absence of a linear pattern formed by one nozzle. In order to determine the missing nozzle in a high-resolution printing head, a camera with high resolution is needed. The process must be performed at high speed in a testing in in-line mode in which, generally, while the testing chart is printed on printing paper transported continuously, the testing chart is read to determine a missing nozzle without stopping the transportation. The process becomes too slow unless a camera with relatively low resolution is used. Consequently, in the testing in in-line mode, there is a possibility that the missing nozzle cannot be determined accurately by the conventional technique.

SUMMARY OF THE INVENTION

This invention has been made having regard to the state of the art noted above, and its object is to provide a nozzle operating situation checking method for inkjet printing apparatus, an inkjet printing apparatus, and a program thereof, which enable an accurate determination of a nozzle operating situation even in a testing in in-line mode.

To fulfill the above object, this invention provides the following construction.

This invention provides a nozzle operating situation checking method for inkjet printing apparatus which perform printing by dispensing ink droplets from a printing head having a plurality of nozzles arranged in a transverse direction of a printing medium perpendicular to a transport direction of the printing medium, the method comprising the steps of printing a grid-shaped testing chart, while transporting the printing medium, to print first line segments over a predetermined distance in the transport direction by dispensing ink droplets from each one of a predetermined number of nozzles located in positions separated in the transverse direction, to print second line segments in the transverse direction by dispensing ink droplets also from the predetermined number of nozzles only when first dispensing ink droplets from the each one nozzle, and when the predetermined distance is reached, to switch to a next nozzle adjoining the each one nozzle in the transverse direction to print the first line segments and the second line segments; reading the testing chart downstream of the printing head while maintaining transportation of the printing medium; extracting grid boxes through image processing of image data of the testing chart; deriving width sizes in the transverse direction from the respective boxes extracted, and deriving a standard width from the width sizes; detecting a box having a width size equal to or larger than a corrected standard width by comparing the width sizes of the respective boxes with the corrected standard width which is obtained by multiplying the standard width by a predetermined coefficient; and determining that a missing nozzle exists upon detection of the box having a width size equal to or larger than the corrected standard width.

According to this invention, after a grid-shaped testing chart is printed, the testing chart is read downstream of the printing head. Subsequently, boxes are extracted from the image data of the testing chart, and a standard width is derived from width sizes of the boxes. The width size of each box is compared with a corrected standard width which is the standard width multiplied by a predetermined coefficient, to detect a box having a width size equal to or larger than the corrected standard width. When there is a box having a width size equal to or larger than the corrected standard width, a determination is made that a missing nozzle exists. Since the missing nozzle is determined from the width sizes of the boxes, the missing nozzle, or an operating situation of the nozzles, can be determined accurately even by an in-line inspection.

In this invention, it is preferred that the method further comprises a step of determining that a deviation exists when a discrepancy results from a comparison between the number of boxes extracted in the extracting step and the number of boxes extracted from the grid-shaped testing chart in time of a normal nozzle operating situation.

A state in which ink droplets dispensed from a nozzle becomes shifted or displaced from target positions to one side in the transverse direction is called "deviation". When such deviation occurs in addition to a missing nozzle, a first line segment will shift in the transverse direction, but a comparison with the corrected standard width may be unable to determine it as abnormal. However, a discrepancy tends to occur between the number of boxes extracted in this case and the number of boxed extracted from the grid-shaped testing chart in time of a normal nozzle operation situation. Consequently, from whether or not there is a discrepancy between the two numbers, whether or not a deviation has occurred can also be determined accurately.

In this invention, it is preferred that the step of deriving the standard width regards as the standard width a value which becomes a median when the width sizes of the boxes are arranged in order of width.

If an average value of the width sizes of all the boxes were adopted as standard width, a box with an extremely different width could exist and its size could affect the standard width, thereby to lower the accuracy of determination. So, the determination of missing nozzle can be obtained with high accuracy by adopting a median of the width sizes of all the boxes arranged in order of width as the standard width.

In this invention, it is preferred that the predetermined coefficient is 1.5.

When the predetermined coefficient is too small, boxes formed normally will be determined erroneously as boxes not being formed. When the predetermined coefficient is too large, boxes not formed normally will be determined erroneously as normal. Thus, the accuracy of determination will become low. So, by multiplying the standard width by the predetermined coefficient of 1.5, variations in the width size of each box can be absorbed, thereby achieving a high accuracy of determination.

In this invention, it is preferred that, when the printing head includes a plurality of head modules, each having a plurality of nozzles, whether the missing nozzle exists or not is determined for each of the head modules.

When the print head includes a plurality of head modules, a response to some trouble is often made with respect to each head module. So, by determining whether the missing nozzle exists for each head module, subsequent measures can be efficiently carried out.

In this invention, it is preferred that, when the printing head includes a plurality of head modules, each having a plurality of nozzles, whether the deviation exists or not is determined for each of the head modules.

When the print head includes a plurality of head modules, a response to some trouble is often made with respect to each head module. So, by determining whether the deviation exists for each head module, subsequent measures can be efficiently carried out.

In another aspect of this invention, an inkjet printing apparatus is provided for performing printing by dispensing ink droplets to a printing medium. The apparatus comprises a printing head having a plurality of nozzles arranged in a transverse direction of the printing medium perpendicular to a transport direction of the printing medium, for performing printing by dispensing the ink droplets to the printing medium; a controller for causing a grid-shaped testing chart to be printed, while transporting the printing medium, to print first line segments over a predetermined distance in the transport direction by dispensing ink droplets from each one of a predetermined number of nozzles located in positions separated in the transverse direction, to print second line segments in the transverse direction by dispensing ink droplets also from the predetermined number of nozzles only when first dispensing ink droplets from the each one nozzle, and when the predetermined distance is reached, to switch to a next nozzle adjoining the each one nozzle in the transverse direction to print the first line segments and the second line segments; a photo unit for photographing, downstream of the printing head, the testing chart printed on the printing medium in a state of the printing medium being transported; a box extractor for extracting grid boxes through image processing from image data of the testing chart photographed by the photo unit; a standard width calculator for deriving width sizes in the transverse direction from the respective boxes extracted by the box extractor, and deriving a standard width from the width sizes; a broad box detector for detecting a box having a width size equal to or larger than a corrected standard width by comparing the width sizes of the respective boxes with the corrected standard width which is obtained by multiplying by a predetermined coefficient the standard width calculated by the standard width calculator; and a missing nozzle determiner for determining that a missing nozzle exists upon detection by the broad box detector of the box having a width size equal to or larger than the corrected standard width.

According to this invention, the controller causes the printing head to print a grid-shaped testing chart, and the photo unit photographs the testing chart. Subsequently, the box extractor extracts grid boxes from the image data of the testing chart, and the standard width calculator derives a standard width from width sizes of the boxes. The broad box detector compares the width size of each box with a corrected standard width which is the standard width multiplied by a predetermined coefficient, and detects a box having a width size equal to or larger than the corrected standard width. When there is a box having a width size equal to or larger than the corrected standard width, the missing nozzle determiner determines that a missing nozzle exists. Since the missing nozzle is determined from the width sizes of the boxes, the missing nozzle, or an operating situation of the nozzles, can be determined accurately even by an in-line inspection.

In this invention, it is preferred that the apparatus further comprises a deviation determiner for determining that a deviation exists when a discrepancy results from a comparison between the number of boxes extracted by the broad box extractor and the number of boxes extracted from the grid-shaped testing chart in time of a normal nozzle operating situation.

When a deviation occurs in addition to a missing nozzle, a first line segment will shift in the transverse direction, but a comparison with the corrected standard width may be unable to determine it as abnormal. However, a discrepancy tends to occur between the number of boxes extracted in this case and the number of boxed extracted from the grid-shaped testing chart in time of a normal nozzle operation situation. Consequently, from whether or not there is a discrepancy between the two numbers, the deviation determiner can also accurately determine whether or not a deviation has occurred.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

An embodiment of this invention will be described hereinafter with reference to the drawings.

Figure 1:
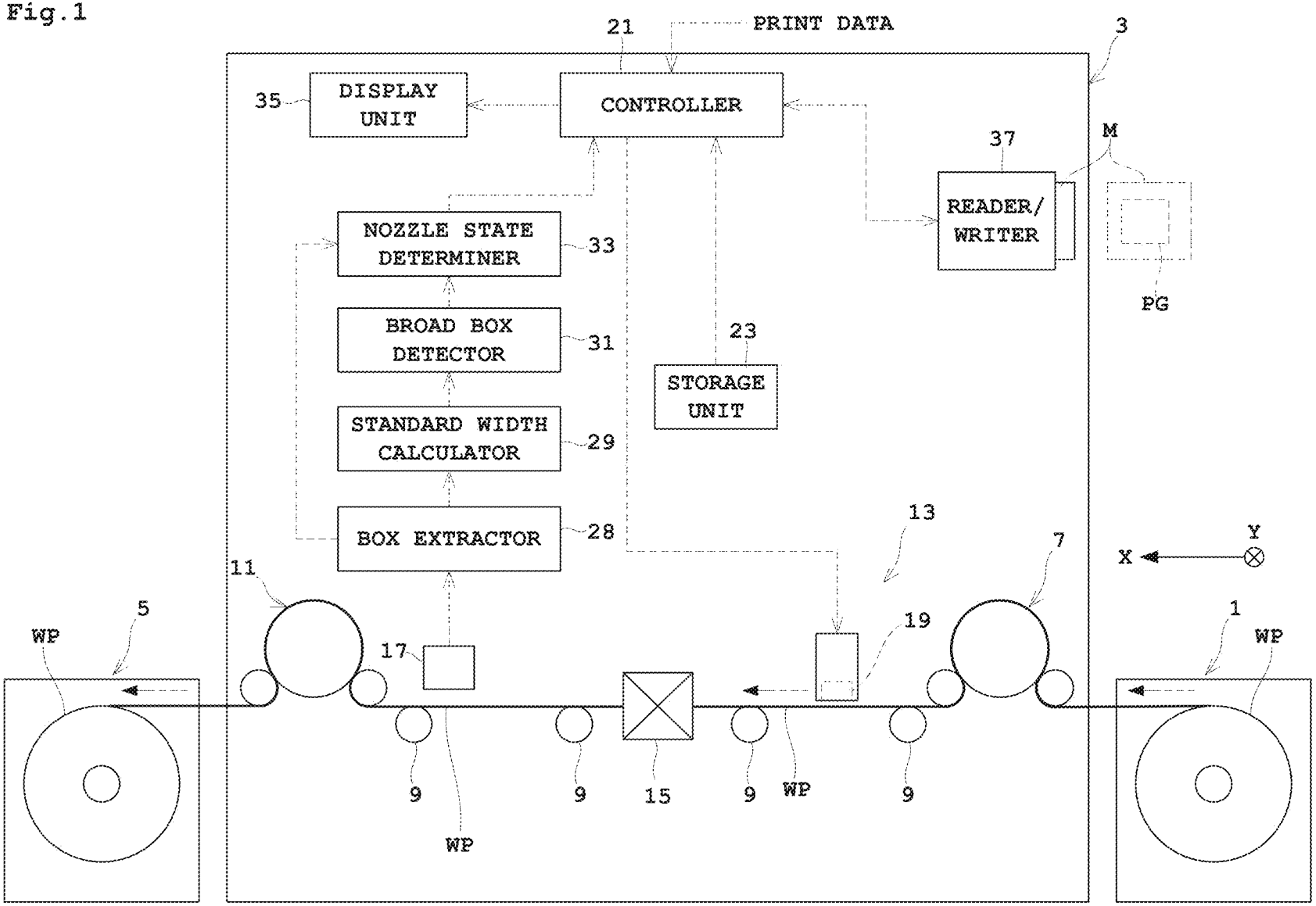
FIG. 1 is an outline schematic view showing an entire inkjet printing system according to an embodiment.
Figure 2:
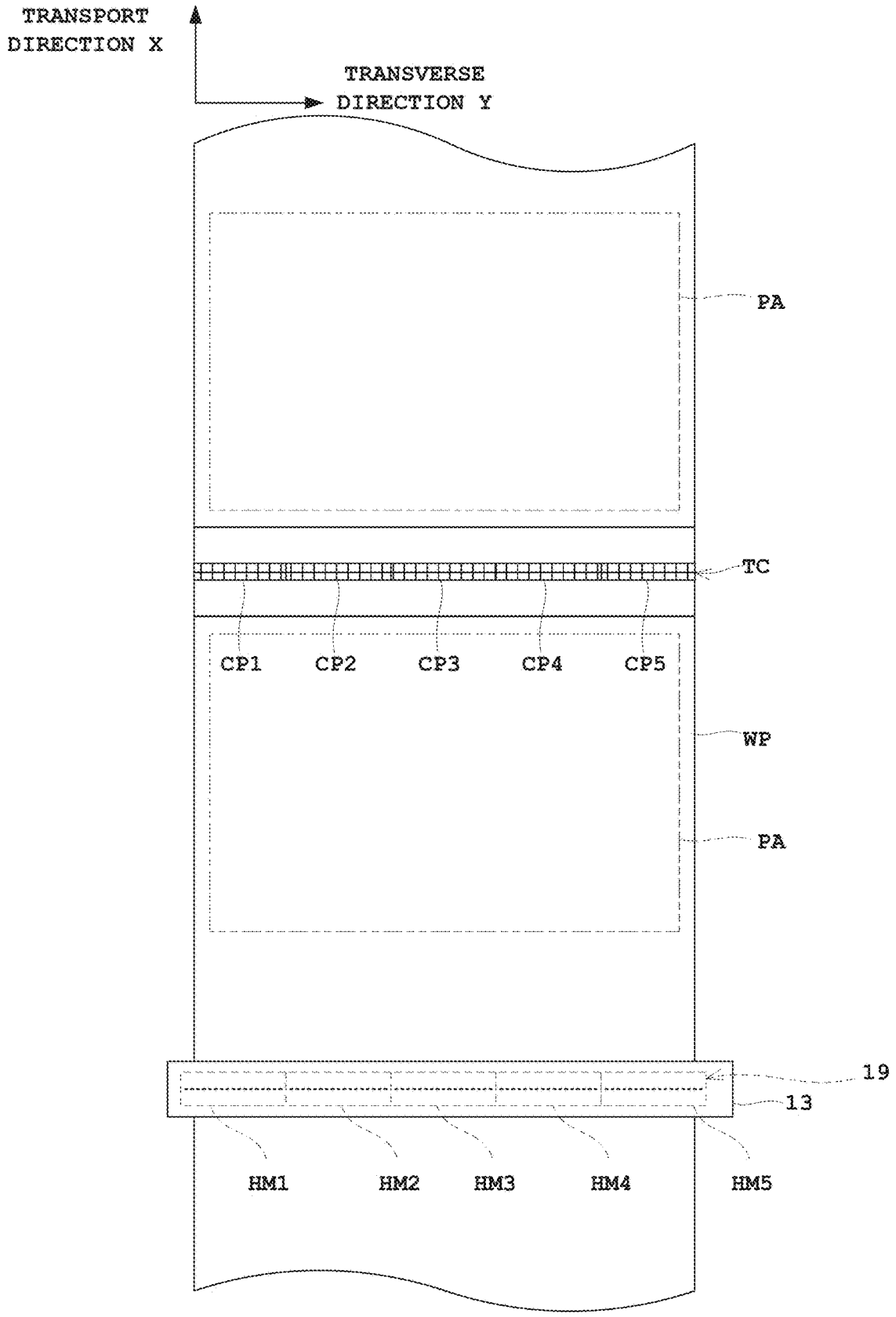
FIG. 2 is a schematic view showing a positional relationship in plan view between web paper and a printing head.

FIG. 1 is an outline schematic view showing an entire inkjet printing system according to the embodiment. FIG. 2 is a schematic view showing a positional relationship in plan view between web paper and a printing head.

The inkjet printing system according to this embodiment includes a paper feeder 1, an inkjet printing apparatus 3, and a takeup roller 5.

The paper feeder 1 holds long web paper WP in a roll form to be rotatable about a horizontal axis, and unwinds and feeds the web paper WP to the inkjet printing apparatus 3. The inkjet printing apparatus 3 performs printing on the web paper WP. The takeup roller 5 takes up on a horizontal axis the web paper WP printed in the inkjet printing apparatus 3. Referring to the side of feeding the web paper WP as upstream and that of discharging the web paper WP as downstream, the paper feeder 1 is located upstream of the inkjet printing apparatus 3, and the takeup roller 5 downstream thereof.

The inkjet printing apparatus 3 includes a drive roller 7 disposed in an upstream position for taking in the web paper WP from the paper feeder 1. The web paper WP unwound from the paper feeder 1 by the drive roller 7 is transported downstream along a plurality of transport rollers 9 toward the takeup roller 5. A drive roller 11 is disposed between the most downstream transport roller 9 and the takeup roller 5. This drive roller 11 feeds the web paper WP transported on the transport rollers 9 forward toward the takeup roller 5. The direction in which the web paper W is transported by the drive roller 7 and transport rollers 9 will be called herein the transport direction X.

The inkjet printing apparatus 3 has a printing unit 13, a dryer 15 and a photo unit 17 arranged in the stated order from upstream between the drive roller 7 and drive roller 11. The dryer 15 dries portions printed by the printing unit 13. The photo unit 17 is a mechanism for reading the web paper WP (printing medium) printed by the printing unit 13, acquires images for checking whether the printed portions have stains, omissions or other defects, for example, and acquires testing chart images which will be described hereinafter. This photo unit 17 acquires a testing chart while maintaining the transportation of web paper WP. The photo unit 17, therefore, has resolution lower than the print resolution of the printing unit 13, for example.

The printing unit 13 has printing heads 19 for dispensing ink droplets. It is common practice to provide a plurality of printing units 13 arranged along the transport direction of web paper WP. For example, four printing units 13 are provided separately for black (K), cyan (C), magenta (M), and yellow (Y). In this embodiment, description will be made assuming that only one printing head 19 is provided, in order to facilitate understanding of the invention. The printing unit 13 includes the printing head 19 with a plurality of head modules just to be capable of printing without moving over a printing area transversely of the web paper WP (i.e. perpendicular to the plane of FIG. 1, which is a direction perpendicular to the transport direction X, and will be referred to as the transverse direction Y).

This printing head 19 has five head modules HM1-HM5, for example. The five head modules are arranged in the direction perpendicular to the transport direction X (i.e. in the transverse direction Y). That is, the inkjet printing apparatus 3 in this embodiment performs printing on the web paper WP while feeding the web paper WP in an auxiliary scanning direction relative to the printing head 19, with the printing head 19 maintained stationary, not moving for main scans in the direction perpendicular to the transport direction of the web paper WP. Such a construction is called one-pass machine.

The drive rollers 7 and 11, printing unit 13, dryer 15, and photo unit 17 are controlled overall by a controller 21. The controller 21 includes a CPU, memory, and so on, and receives from outside print data including image information for printing on the web paper WP.

The controller 21 carries out printing through the printing unit 13 by referring to the print data stored in a storage unit 23 for printing the testing chart, and giving the printing unit 13 drive voltages according to this print data and the print data received from outside. At this time, the controller 21 controls drive speed of the drive rollers 7 and 11 according to printing speed and ink droplet dispensation rates of the printing unit 13. The controller 21 executes a program PG and the like to be described hereinafter to carry out various processes. The testing chart TC, as shown in FIG. 2, for example, is printed between a print area PA and a print area PA which are used for product printing. The testing chart TC is therefore photographed by the photo unit 17 without stopping transportation of the web paper WP. As described in detail hereinafter, the testing chart TC has patches CP1-CP5 respectively printed by the head modules HM1-5 as arranged in one row in the transverse direction Y. Each of the patches CP1-CP5 constituting the testing chart TC is grid-shaped. The testing chart TC is not necessarily printed between the print areas PA, but may be printed in an area before printing a first print area PA.

The photo unit 17 has built therein a scanner of relatively low resolution, for example. Specifically, when the print resolution by the printing unit 13 is 1200 dpi, for example, the photo unit 17 has a photographic resolution about ¼, such as 353 dpi. The image data acquired by the photo unit 17 is given to a box extractor 27.

Figure 3:
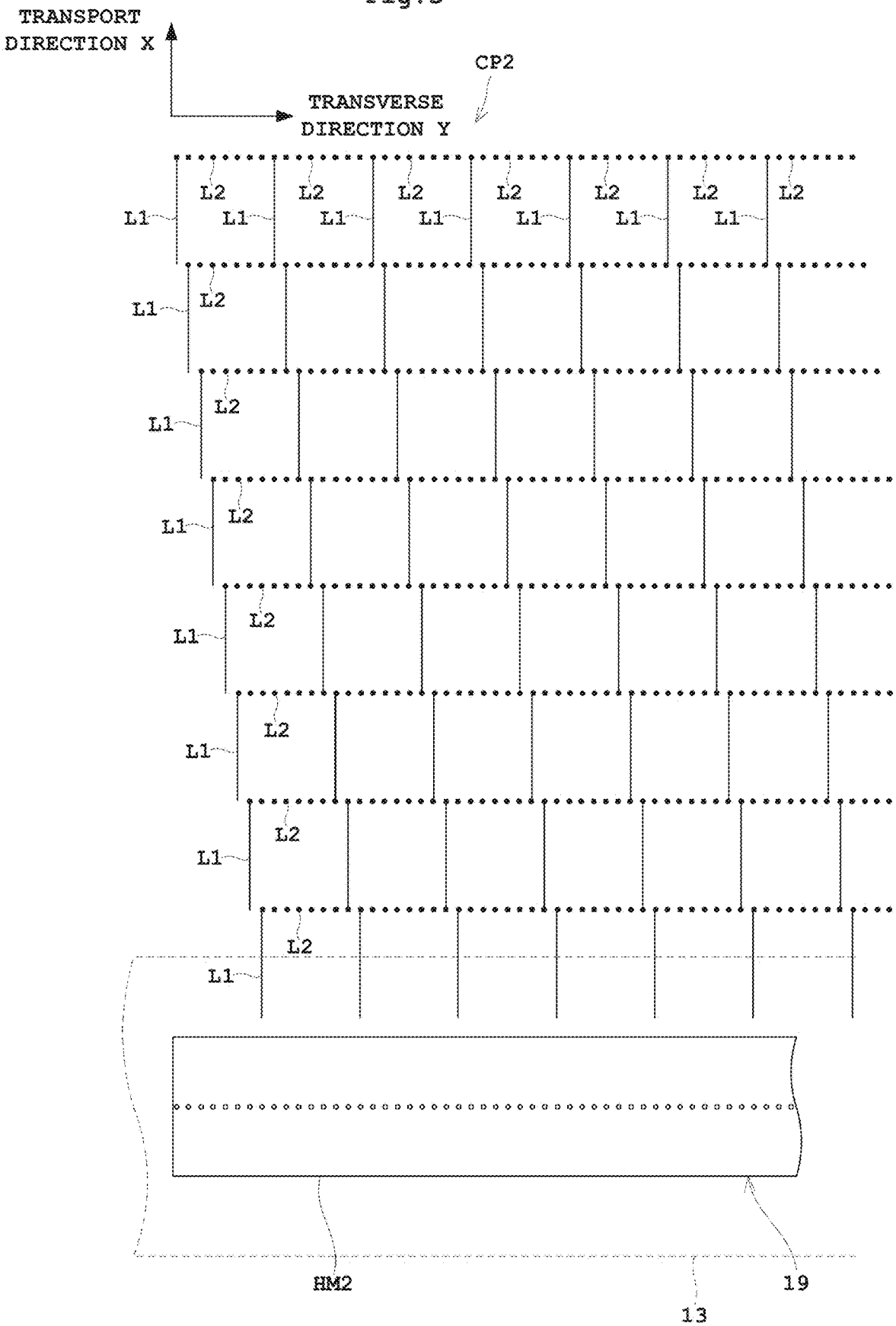
FIG. 3 is an enlarged schematic view of a portion of testing chart patches.

Reference is now made to FIG. 3. FIG. 3 is an enlarged schematic view of a portion of testing chart patches.

The testing chart TC shown in FIG. 2 has patches CP1-5 corresponding to the head modules HM1-HM5, respectively. The testing chart TC, i.e. each of the patches CP1-CP5, is constructed as shown in FIG. 3, for example.

Description will be made here taking the patch CP2 for example in order to facilitate understanding of the invention, but the same applies to the other patches CP1 and CP3-CP5. For the patch CP2, while transporting the web paper WP, first line segments L1 are printed over a predetermined distance in the transport direction X by dispensing ink droplets from each of a predetermined plurality of (e.g. seven here) nozzles in positions separated in the transverse direction Y. Further, second line segments L2 are printed in the transverse direction Y by dispensing ink droplets also from the predetermined plurality of nozzles only when the ink droplets are first dispensed from each nozzle. When the first line segments L1 reach the predetermined distance, a switching is made to a next each nozzle adjoining the each nozzle in one transverse direction Y, and first line segments L1 are printed. Then, second line segments L2 are printed in the transverse direction Y by dispensing ink droplets also from the predetermined plurality of nozzles only when the ink droplets are first dispensed from each nozzle to which the switching has been made. Consequently, the testing chart TC is printed, which includes the grid-like patch CP2 as shown in FIG. 3. Although, in FIG. 3, the second line segments L2 are depicted in dots, this is done for the purpose of description to distinguish from the first line segments L1. In practice, the second line segments L2 are printed in linear form as are the first line segments L1.

The above predetermined plurality which separates the nozzles is set to provide a distance enabling resolution between adjoining first line segments L1 even if the photo unit 17 has low resolution. Consequently, although the first line segments L1 separate the seven nozzles in the following description, the number may be less as long as the first line segments L1 enable resolution between the first line segments L1 in image data.

The box extractor 27 in FIG. 1 performs image processing, and clips the patches CP1-CP5 out of the image data of testing chart TC. Further, the box extractor 27 extracts grid boxes from the patches CP1-CP5.

A standard width calculator 29 derives a width size in the transverse direction Y from each box extracted by the box extractor 27. The standard width calculator 29 derives a standard width from the width sizes of the boxes. At this time, the standard width calculator 29 preferably arranges the width sizes of the boxes in order of width, obtains a width size located in the middle as median, and determines this to be a standard width for all the boxes. An average value adopted as the standard width could be strongly influenced by excessively large or small width sizes, and thus a possibility of false detection in a process described hereinafter. The median serving as the standard width has an advantage of being able to avoid such an inconvenience.

The standard width calculation technique by the standard width calculator 29 is not limited to the above median, but may employ the most frequent occurrence value instead, for example.

A broad box detector 31 compares the width size of each box with a corrected standard width corresponding to the standard width multiplied by a predetermined coefficient as calculated by the standard width detector 29. Consequently, the broad box detector 31 detects boxes with width sizes equal to or larger than the corrected standard width. The predetermined coefficient, preferably, is 1.5, for example. This is because, when the predetermined coefficient is less than 1.5, there is a possibility that width sizes only slightly larger than the standard width can be determined broad, and when the predetermined coefficient exceeds 1.5, there is a possibility that excessively large width sizes can be determined normal.

A nozzle state determiner 33 determines that a missing nozzle has occurred when the above broad box detector 31 detects a box equal to or larger than the corrected standard width. The nozzle state determiner 33 compares the number of boxes extracted by the box extractor 27 and the number of boxes extracted from the patches CP1-CP5 in a normal state of the nozzle operating situation, and determines that a deviation has occurred when there is a discrepancy between the two numbers. The result of determination is outputted to the controller 21.

A display unit 35 is operated by the controller 21 to show various displays. When the nozzle state determiner 33 determines that a missing nozzle or a deviation has occurred, the controller 21 displays such occurrence on the display unit 35 to report that an abnormality has occurred in the nozzle operating situation to the operator of the inkjet printing system.

A reader/writer 37 is connected to the controller 21. A program PG for processing by this apparatus is stored in a storage medium M. This program PG is read into the controller 21 when the storage medium M is attached to the reader/writer 37 and is executed by the controller 21.

The above web paper WP corresponds to the "printing medium" in this invention. The nozzle state determiner 33 corresponds to the "missing nozzle determiner" and "deviation determiner" in this invention.

Next, determination of nozzle operating situations due to the missing nozzle and deviation will be described with reference to FIGS. 4 through 9.

Figure 4:
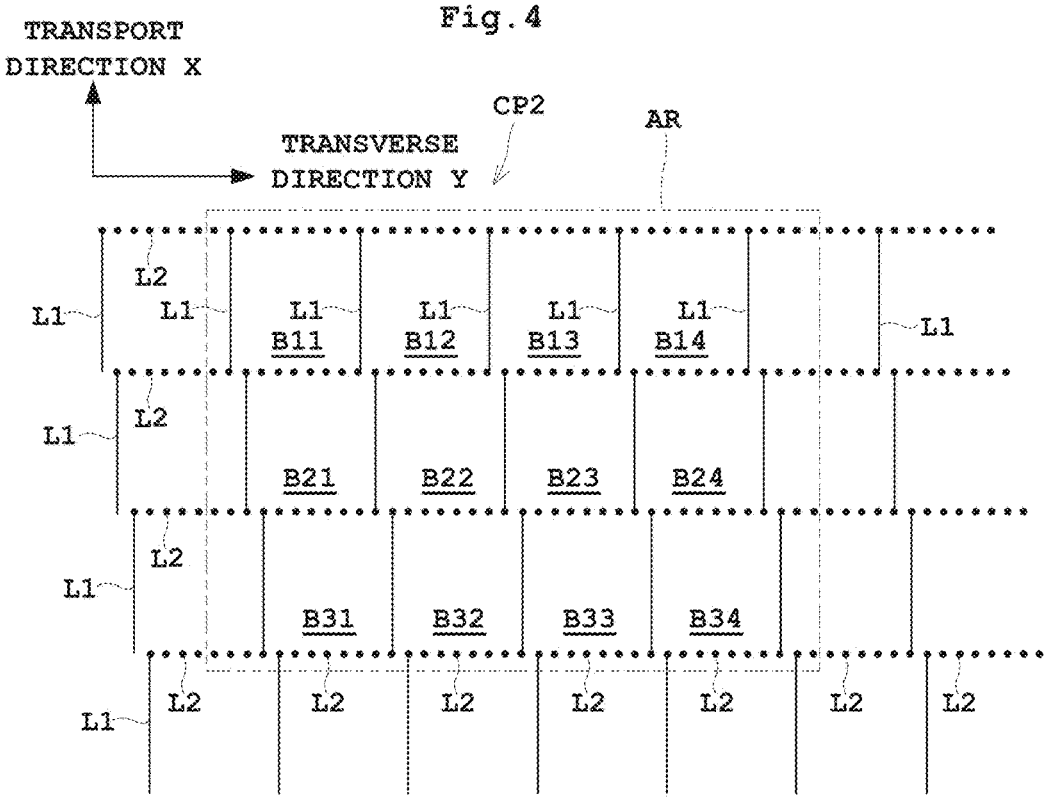
FIG. 4 is a schematic view showing a testing chart in a state of having no missing nozzle.
Figure 5:
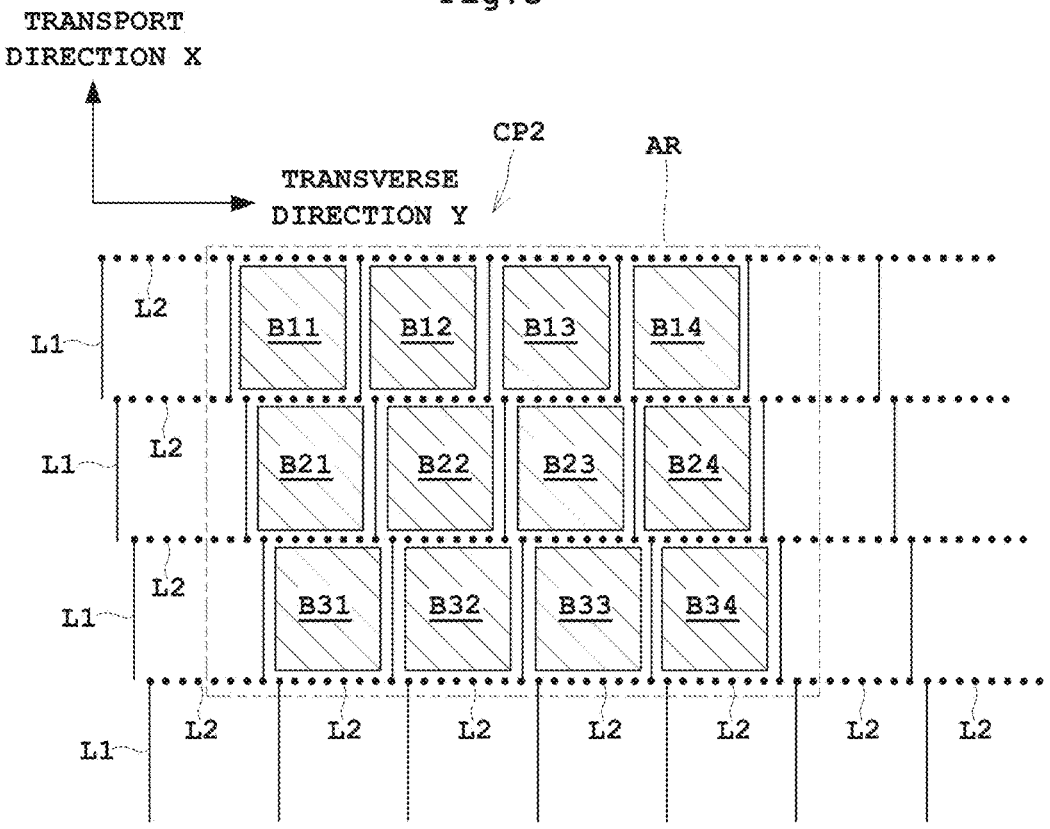
FIG. 5 is a schematic view showing box detection in a normal state free of a missing nozzle.
Figure 6:
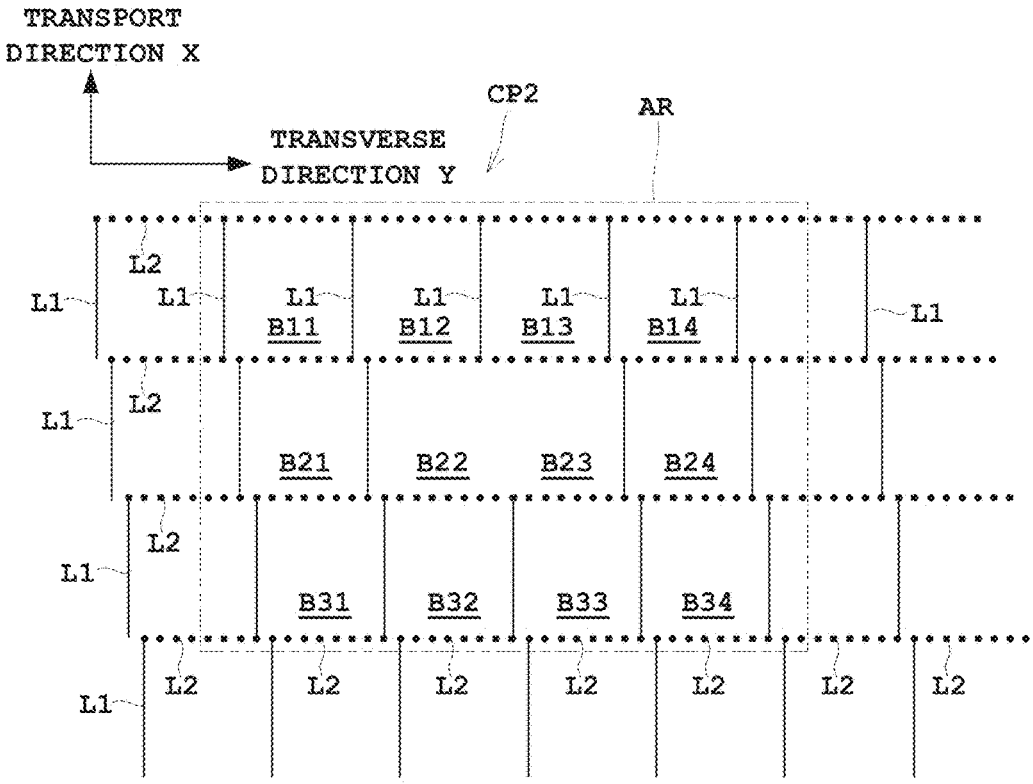
FIG. 6 is a schematic view showing a testing chart in a state of having a missing nozzle.
Figure 7:
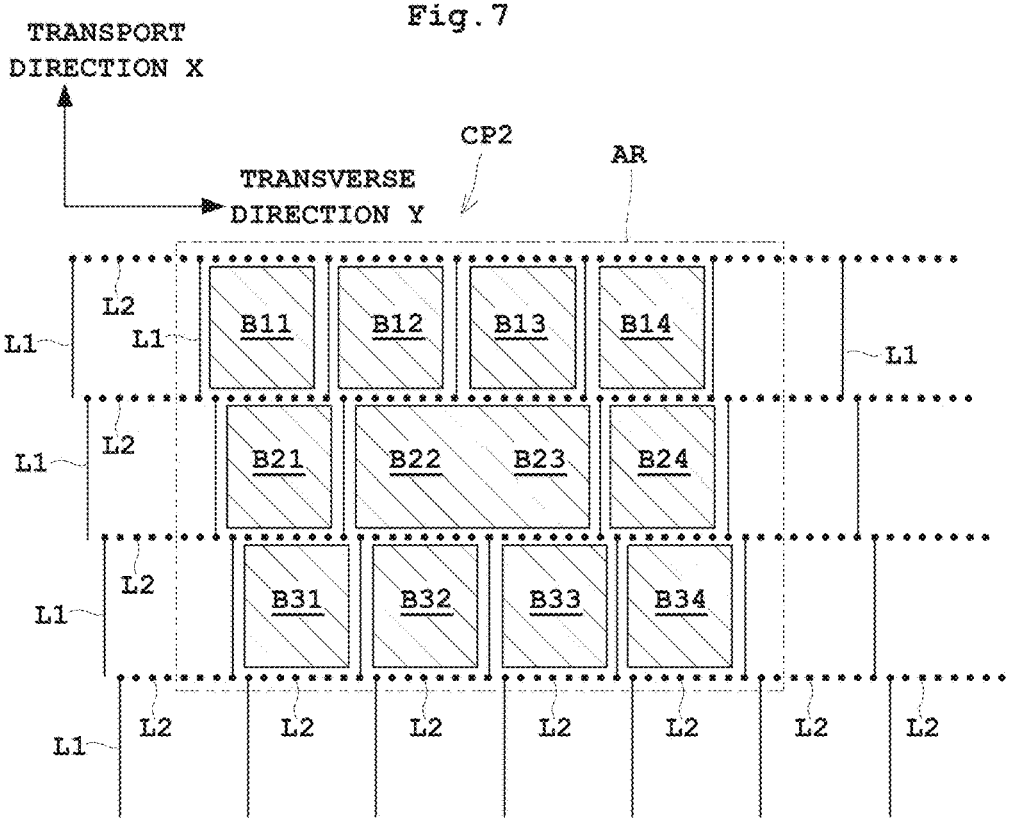
FIG. 7 is a schematic view showing box detection in the state of having a missing nozzle.
Figure 8:
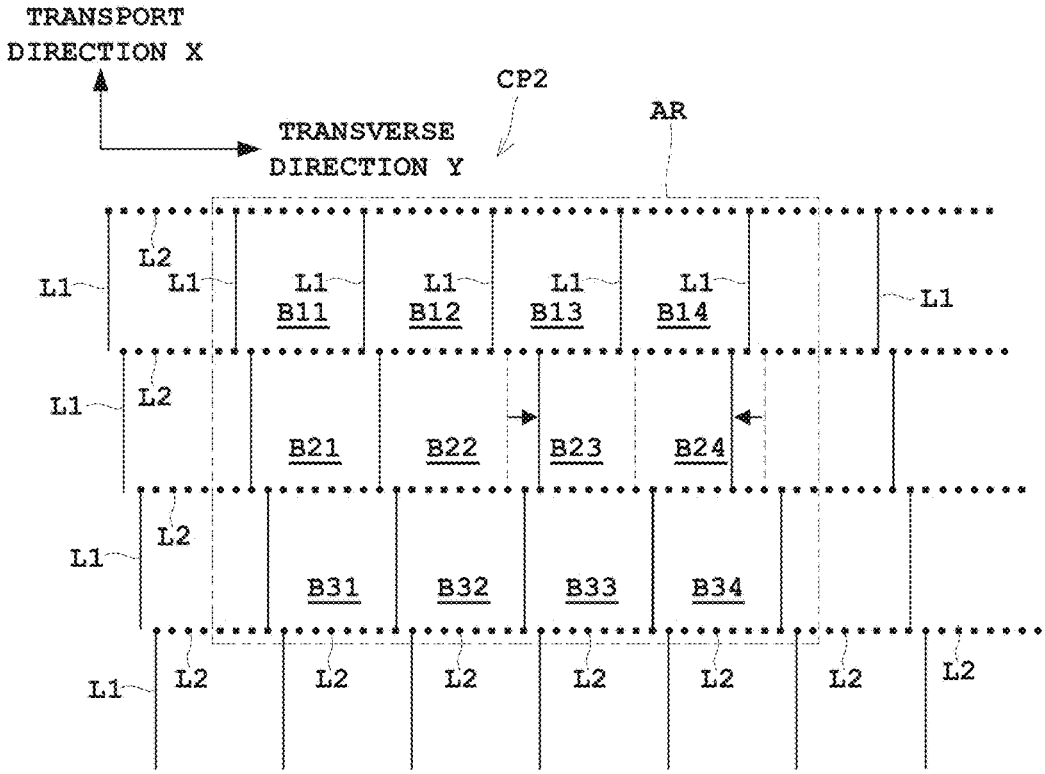
FIG. 8 is a schematic view showing a testing chart in a state of having a deviation and a missing nozzle.
Figure 9:
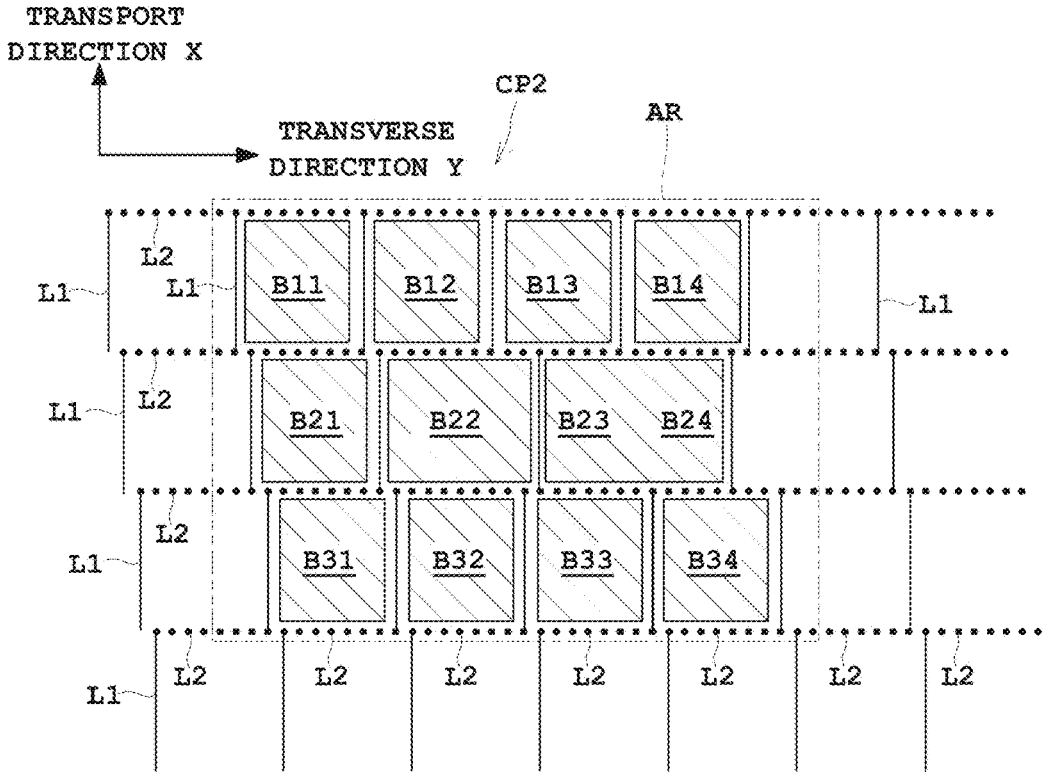
FIG. 9 is a schematic view showing box detection in the state of having a deviation and a missing nozzle.

FIG. 4 is a schematic view showing a testing chart in a state of having no missing nozzle. FIG. 5 is a schematic view showing box detection in a normal state free of a missing nozzle. FIG. 6 is a schematic view showing a testing chart in a state of having a missing nozzle. FIG. 7 is a schematic view showing box detection in the state of having a missing nozzle. FIG. 8 is a schematic view showing a testing chart in a state of having a deviation and a missing nozzle. FIG. 9 is a schematic view showing box detection in the state of having a deviation and a missing nozzle.

Here, in order to facilitate understanding of the invention, as shown in FIG. 4, description will be made by limiting the testing chart TC to a predetermined area AR which includes 12 boxes with the nozzle operating situation being normal.

FIG. 4 is a testing chart in the state of having no missing nozzle or the like, in which all of boxes B11-B14, B21-B24 and B31-B34 are printed. In this case, the box extractor 27 extracts a total of 12 boxes B11-B14, B21-B24 and B31-B34 from the predetermined area AR, which is made up of three boxes in the transport direction X and four boxes in the transverse direction Y. When no missing nozzle exists, the width size of each of the boxes B11-B14, B21-B24 and B31-B34, as shown in FIG. 5, does not exceed the corrected standard width which corresponds to 1.5 times the median of the width sizes of boxes B11-B14, B21-B24 and B31-B34, and thus an abnormality of the nozzle operating situation is never detected.

FIG. 6 is a testing chart in a state of having a missing nozzle adjacent the center of the predetermined area AR, in which the first line segment L1 between boxes B22 and B23 is missing. In this case, as shown in FIG. 7, only three boxes, i.e. box B21, a box consisting of boxes B22 and B23, and box B24, are extracted from the row of box B21 in the transverse direction Y of the predetermined area AR. Consequently, the number of boxes in the predetermined area AR becomes 11 which is fewer than the normal 12 boxes. Further, since only the central box consisting of boxes B22 and B23 has a width size larger than the corrected standard width, an abnormality of the nozzle operating situation is detected.

FIG. 8 is a testing chart in a state of having a missing nozzle and a deviation adjacent the center of the predetermined area AR, in which the first line segment L1 between boxes B23 and B24 is missing, and furthermore the first line segment L1 on the left side of box B23 has deviated rightward in the transverse direction Y, and the first line segment L1 on the right side of box B24 has deviated leftward in the transverse direction Y. In this case, as shown in FIG. 9, only three boxes, i.e. box B21, box B22, and a box consisting of boxes B23 and B24, are extracted from the row of box B21 in the transverse direction Y of the predetermined area AR. In this case, since the two adjacent first line segments L1 have moved toward each other, the width sizes of box B22 and the box consisting of boxes B23 and B24 are assumed not larger than the corrected standard width. Even in such a case, by comparing the number of boxes extracted from the predetermined area AR is compared with the number of boxes which should be extracted when the nozzle operating situation is normal, an abnormality of the nozzle operating situation due to a deviation or missing nozzle is detected.

Figure 10:
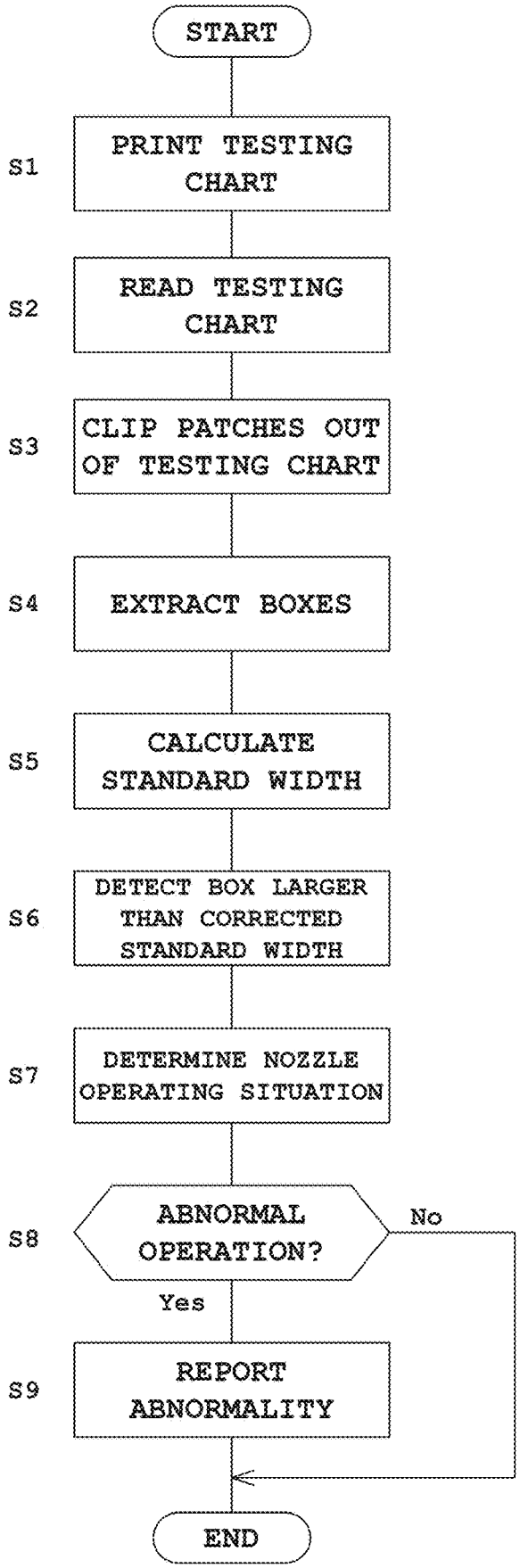
FIG. 10 is a flow chart showing a sequence of a nozzle operating situation checking process.

Next, a nozzle operating situation checking process in the inkjet printing system having the foregoing construction will be described with reference to FIG. 10. FIG. 10 is a flow chart showing a sequence of the nozzle operating situation checking process.

Step S1

The controller 21 carries out product printing in print areas PA while transporting the web paper WP, and prints the testing chart TC between the print areas PA as shown in FIG. 2.

Step S2

The controller 21 operates the photo unit 17 and reads with the photo unit 17 the testing chart TC from the web paper WP in continuous transportation.

Step S3

The box extractor 27 clips patches CP1-5CP5 corresponding to the respective head modules HM1-HM5 from the read testing chart TC.

Step S4

The box extractor 27 extracts grid boxes of each of the patches CP1-CP5.

Step S5

The standard width calculator 29 obtains width sizes in the transverse direction of the extracted boxes of each of the patches CP1-CP5, and calculates a standard width for each of the patches CP1-CP5 based on the median.

Step S6

The broad box detector 31 compares the corrected standard width for each of the patches CP1-CP5, a width size of each box in the patches CP1-CP5, and the corrected standard width of corresponding one of the patches CP1-CP5. As a result, the broad box detector 31 detects a box having become larger than the corrected standard width for each of the patches CP1-CP5.

Step S7

The nozzle state determiner 33 determines a nozzle operation situation regarding each of the head modules HM1-HM5 based on detection results by the broad box detector 31 and the number of boxes detected for each of the patches CP1-CP5 by the box extractor 27. That is, the nozzle state determiner 33 determines whether a missing nozzle or a deviation has occurred with each of the head modules HM1-HM5.

Steps S8 and S9

The controller 21, when the results of determination by the nozzle state determiner 33 show an abnormality in the nozzle operating situation, moves on to step S9 and reports on the display unit 35 that the abnormality has occurred in the nozzle operating situation. On the other hand, when there is no abnormality in the nozzle operating situation, the controller 21 ends the nozzle state determining process. This process is performed while the printing on the web paper WP is maintained.

When the abnormality in the nozzle operating situation is reported, the operator of the apparatus performs nozzle operation recovery processes such as flushing, head module changing, and so on.

According to this embodiment, the controller 21 makes the printing head 19 print a grid-shaped testing chart TC on the web paper WP, and the photo unit 17 photographs the testing chart TC downstream of the printing head 19. Subsequently, the box extractor 27 extracts grid boxes from the image data of the testing chart TC, and the standard width calculator 29 derives a standard width from width sizes of the boxes. The broad box detector 31 compares the width size of each box and a corrected standard width which is the standard width multiplied by a predetermined coefficient, and detects a box having a width size larger than the corrected standard width. When there is a box having a width size larger than the corrected standard width, or when there are fewer boxes than at a normal time, the nozzle state determiner 33 determines an occurrence of a missing nozzle or a deviation. Since a nozzle state is determined from the width sizes of the boxes, an operating situation of the nozzles can be determined accurately even by an in-line inspection by the photo unit 17 with photographic resolution lower than print resolution.

Figure 11:
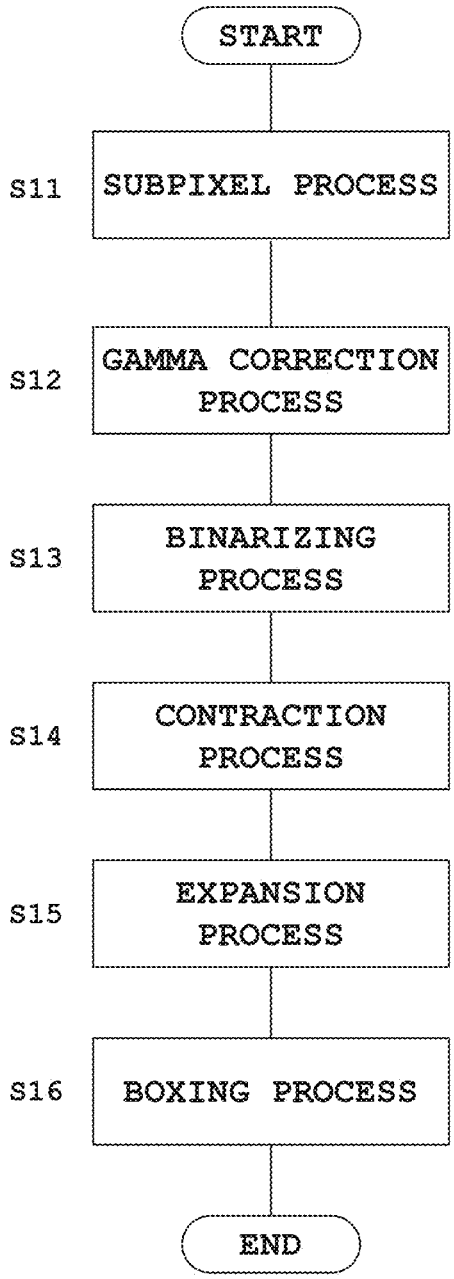
FIG. 11 is a flow chart showing desirable processes for extracting boxes.

Desirable processes at the time of extracting the boxes for the above nozzle state determination will be described with reference to FIGS. 11 and 12. FIG. 11 is a flow chart showing the desirable processes for extracting the boxes. FIGS. 12A-12F are views illustrating the desirable processes for extracting the boxes. Description will be made hereinafter only of the patch CP2 corresponding to head module HM2, but the same applies to the other patches CP1 and CP3-CP5.

In the foregoing embodiment, the head modules HM1-HM5 of the printing head 19 have been described as arranged linearly in the transverse direction Y. However, there is a type of printing head 19 having a plurality of head modules arranged in what is known as "zigzag arrangement" in which the ends of adjoining head modules overlap each other as seen in the transport direction X. FIGS. 12A-12F referred to in the following description show a construction different from the foregoing embodiment in adopting this "zigzag arrangement".

Steps S11 and S12

Figures 12A, 12B, 12C, 12D, 12E, 12F:
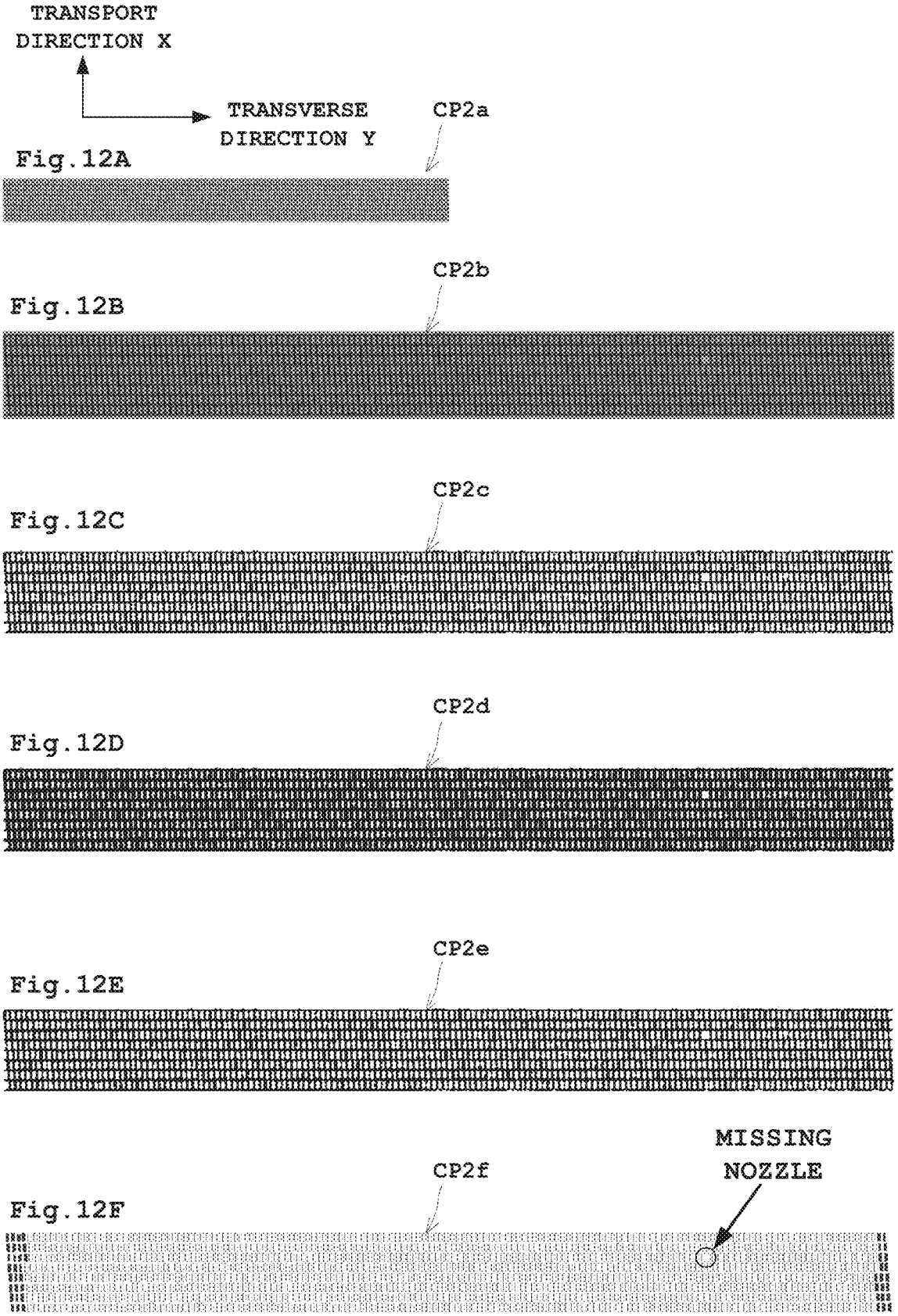
FIGS. 12A-12F are views illustrating the desirable processes for extracting the boxes.

The box extractor 27, as shown in FIG. 12A, clips the image data of patch CP2 of the head module HM2 from the testing chart TC. Assume here that this patch is patch CP2*a*. The box extractor 27 performs a subpixel process on patch CP2*a*. The subpixel process is a process for increasing the number of pixels in patch CP2*a* to achieve higher resolution. Further, the box extractor 27 performs a gamma correction process. Consequently, as shown in FIG. 12B, the number of pixels is increased to make patch CP2*a* into patch CP2*b* with enhanced light and shade. These subpixel and gamma correction processes enable subsequent processes to be carried out with high accuracy.

Step S13

The box extractor 27 performs a binarizing process on patch CP2*b*. This results in patch CP2*c* as shown in FIG. 12C.

Step S14

The box extractor 27 performs a contraction process on patch CP2*c*. The contraction process is a process carried out, based on a pixel having a pixel value corresponding to white and used as reference, for replacing a pixel of interest with a black pixel when there is at least one black pixel around the pixel of interest. Consequently, as shown in FIG. 12D, the resulting patch CP2*d* has locations of the first line segments L1 and second line segments L2 processed to be thick.

Step S15

The box extractor 27 performs an expansion process on patch CP2*d*. The expansion process is a process carried out, based on the pixel having the pixel value corresponding to white and used as reference, for replacing a pixel of interest with a white pixel when there is at least one white pixel around the pixel of interest. Consequently, as shown in FIG. 12E, patch CP2*d* is made into patch CP2*e*. For example, the patch CP2*a* read by the photo unit 17, although the first line segments L1 and second line segments L2 are printed on the web paper WP, may be blurred on the data. However, the above step S13 and step S14 can process blurred parts of the first line segments L1 and second line segments L2 into clear line segments. Consequently, the accuracy of extracting the boxes can be improved.

Step S16

The box extractor 27 detects the first line segments L1 and second line segments L2 in patch CP2*e*, and boxes the enclosed areas. Consequently, as shown in FIG. 12F, patch CP2*e* is made into boxed patch CP2*f*. FIG. 12F shows black boxes located at the right and left ends. This is due to employment of the construction of "zigzag arrangement", and shows that these boxes are excluded from the targets for boxing.

Since the boxes can be extracted with high accuracy by extracting the boxes by the above processes, the nozzle operating situation can be checked accurately. The location indicated by a circle and an arrow in FIG. 12F is a portion where a missing nozzle has occurred.

Figure 13:
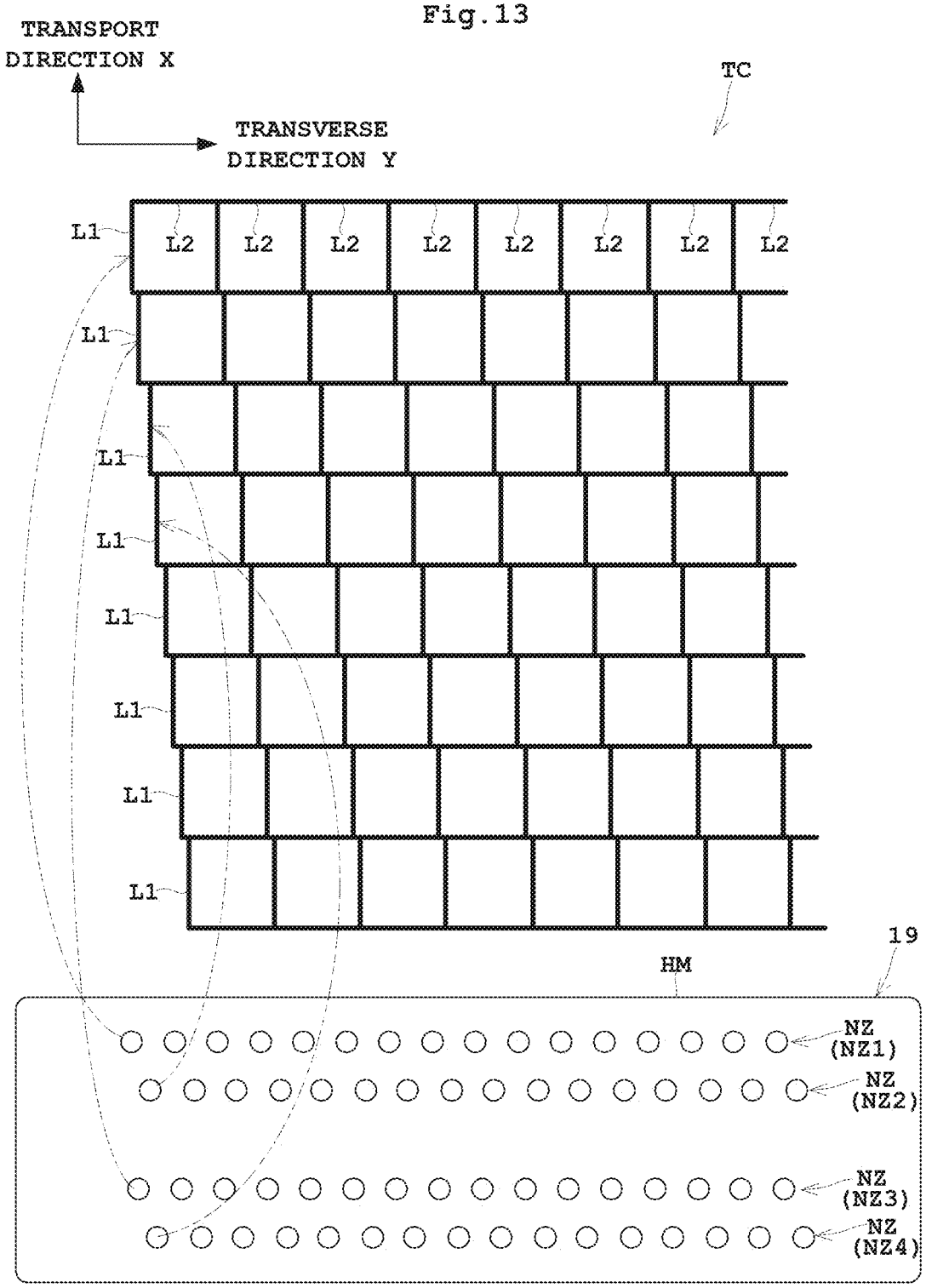
FIG. 13 is a schematic view showing a relationship between a head module with a zigzag arrangement and a testing chart.

This invention is not limited to the foregoing embodiment, but may be modified as follows:

(1) In the foregoing embodiment, the printing head 19 has a plurality of nozzles of head modules HM1-HM5 arranged linearly in one row in the transverse direction Y. However, this invention is not limited to such printing head 19. For example, this invention is applicable also to a printing head 19 having a head module HM shown in FIG. 13.

This head module HM is constructed to have a plurality of nozzles arranged in four rows (nozzle rows NZ1-NZ4) in the transport directions X. Each of the nozzle lines NZ1-NZ4 is shifted only a minute distance in the transverse direction Y so that the center of each nozzle may not overlap the others as seen in the transport direction X. The head module HM of such construction can be treated as in the foregoing embodiment by printing the first line segments L1 as indicated by arrowed two-dot chain lines.

(2) In the foregoing embodiment, what is reported is only whether a missing nozzle or a deviation has occurred or not. However, to which nozzle the trouble has occurred may also be reported. That is, since the relationship between the first line segments L1 and second line segments L2 in patches CP1-CP5 and the nozzles of the head modules HM1-HM5 is known, what is necessary, regarding the missing nozzle, is just to report the number of the nozzle which should have printed a missing first line segment L1. Each box has the first line segment L1 on the left side thereof as reference, and so what is to be reported is the number of the nozzle located on the right side in the transverse direction of the box of the nozzle corresponding to the first line segment L1 on the left side of the box exceeding the corrected standard width. Regarding the deviation, the nozzle causing the deviation can be identified by referring to the difference in the transverse direction Y of the first line segment L1 in the area having a discrepant number of boxes, from the first line segments L1 located upstream and downstream in the transport direction X. So what is necessary is just to report the number of that nozzle.

(3) In the foregoing embodiment, the report is given only to the extent of the nozzle operating situation, but this invention is not limited to such construction. Flushing for recovering a missing nozzle may be changed according to results of the nozzle operating situation. For example, flushing may be strengthened for a head module or nozzle having caused the missing nozzle.

(4) In the foregoing embodiment, the printing head 19 is constructed to include five head modules HM1-HM5. This invention is not limited to such construction. The print head 19 may be constructed of two or more head modules, or may have one head module.

(5) In the foregoing embodiment, the broad box detector 31 sets the corrected standard width with the predetermined coefficient 1.5. This invention is not limited to this. For example, it may be a value somewhat more or less than 1.5.

(6) In the foregoing embodiment, the nozzle operating situation is checked with respect to a missing nozzle and a deviation. However, only a missing nozzle may be checked.

(7) In the foregoing embodiment, the nozzle operating situation is checked for each of the head modules HM1-HM5, but this may be carried out for each of the printing heads 19 along with the head modules HM1-HM5. Conversely, each of the head modules HM1-HM5 may be divided into predetermined areas, and checking may be carried out on an area-by-area basis.

(8) In the foregoing embodiment, the web paper WP is used as printing medium, but cut sheet paper may be used. The printing medium is not limited to paper, but may be film sheet.

Figure 14:
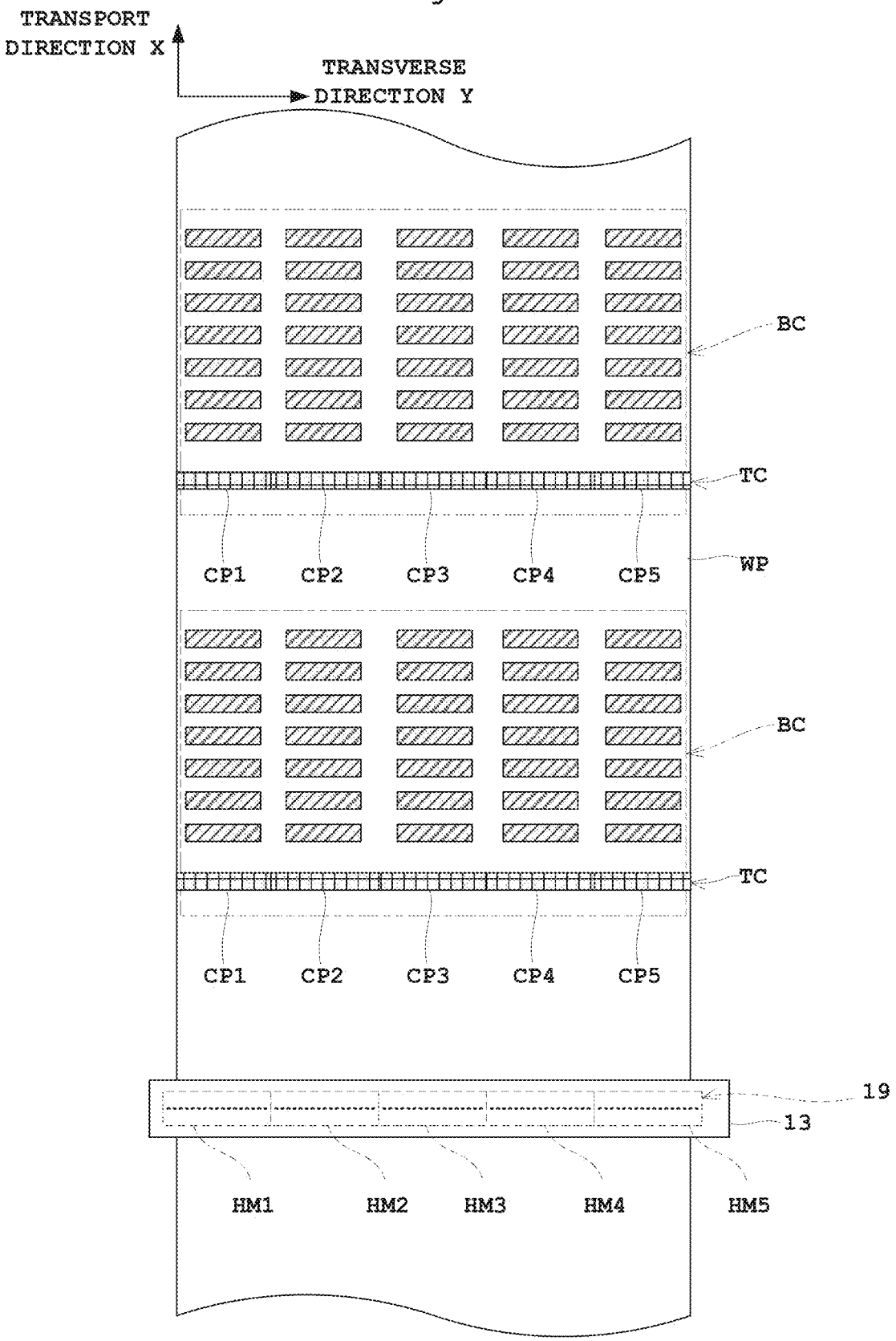
FIG. 14 is a schematic view of another example of positional relationship in plan view between web paper and a printing head.

(9) In the foregoing embodiment, the testing chart TC is printed between two adjacent print areas PA. The print position of testing chart TC is not limited there. As shown in FIG. 14, for example, each testing chart TC may be printed in a basic chart BC. In the inkjet printing apparatus 3, the basic chart BC may be printed as a job different from actual prints. The basic chart BC is, generally, printed after an adjustment such as correcting a drive voltage for each of the head modules HM1-HM5 of printing head 19, in order to check whether the adjustment has been carried out appropriately. When the testing chart TC is printed in the basic chart BC, an operation for checking operation of the nozzles using the testing chart TC can be carried out at the same time as an operation for checking the drive voltages and the like using the basic chart BC. Note that, when the testing chart TC is printed in the basic chart BC, an operation is needed for clipping the testing chart TC out of a read image of the basic chart BC. This operation corresponds to step S3 of FIG. 10. After clipping the testing chart TC, the same operations are performed as in the foregoing embodiment.

This invention may be embodied in other specific forms without departing from the spirit or essential attributes thereof and, accordingly, reference should be made to the appended claims, rather than to the foregoing specification, as indicating the scope of the invention.

What is claimed is:

1. A nozzle operating situation checking method for inkjet printing apparatus which perform printing by dispensing ink droplets from a printing head having a plurality of nozzles arranged in a transverse direction of a printing medium perpendicular to a transport direction of the printing medium, the method comprising the steps of:

printing a grid-shaped testing chart, while transporting the printing medium, to print first line segments over a predetermined distance in the transport direction by dispensing ink droplets from each one of a predetermined number of nozzles located in positions separated in the transverse direction, to print second line segments in the transverse direction by dispensing ink droplets also from the predetermined number of nozzles only when first dispensing ink droplets from the each one nozzle, and when the predetermined distance is reached, to switch to a next nozzle adjoining the each one nozzle in the transverse direction to print the first line segments and the second line segments;

reading the testing chart downstream of the printing head while maintaining transportation of the printing medium;

extracting grid boxes through image processing of image data of the testing chart;

deriving width sizes in the transverse direction from the respective boxes extracted, and deriving a standard width from the width sizes;

detecting a box having a width size equal to or larger than a corrected standard width by comparing the width sizes of the respective boxes with the corrected standard width which is obtained by multiplying the standard width by a predetermined coefficient; and determining that a missing nozzle exists upon detection of the box having a width size equal to or larger than the corrected standard width.

2. The nozzle operating situation checking method for inkjet printing apparatus according to claim 1, further comprising a step of determining that a deviation exists when a discrepancy results from a comparison between the number of boxes extracted in the extracting step and the number of boxes extracted from the grid-shaped testing chart in time of a normal nozzle operating situation.

3. The nozzle operating situation checking method for inkjet printing apparatus according to claim 2, wherein the step of deriving the standard width regards as the standard width a value which becomes a median when the width sizes of the boxes are arranged in order of width.

4. The nozzle operating situation checking method for inkjet printing apparatus according to claim 3, wherein the predetermined coefficient is 1.5.

5. The nozzle operating situation checking method for inkjet printing apparatus according to claim 2, wherein the predetermined coefficient is 1.5.

6. The nozzle operating situation checking method for inkjet printing apparatus according to claim 2, wherein, when the printing head includes a plurality of head modules, each having a plurality of nozzles, whether the missing nozzle exists or not is determined for each of the head modules.

7. The nozzle operating situation checking method for inkjet printing apparatus according to claim 2, wherein, when the printing head includes a plurality of head modules, each having a plurality of nozzles, whether the deviation exists or not is determined for each of the head modules.

8. The nozzle operating situation checking method for inkjet printing apparatus according to claim 1, wherein the step of deriving the standard width regards as the standard width a value which becomes a median when the width sizes of the boxes are arranged in order of width.

9. The nozzle operating situation checking method for inkjet printing apparatus according to claim 8, wherein the predetermined coefficient is 1.5.

10. The nozzle operating situation checking method for inkjet printing apparatus according to claim 8, wherein, when the printing head includes a plurality of head modules, each having a plurality of nozzles, whether the missing nozzle exists or not is determined for each of the head modules.

11. The nozzle operating situation checking method for inkjet printing apparatus according to claim 8, wherein, when the printing head includes a plurality of head modules, each having a plurality of nozzles, whether the deviation exists or not is determined for each of the head modules.

12. The nozzle operating situation checking method for inkjet printing apparatus according to claim 1, wherein the predetermined coefficient is 1.5.

13. The nozzle operating situation checking method for inkjet printing apparatus according to claim 5, wherein, when the printing head includes a plurality of head modules, each having a plurality of nozzles, whether the missing nozzle exists or not is determined for each of the head modules.

14. The nozzle operating situation checking method for inkjet printing apparatus according to claim 12, wherein, when the printing head includes a plurality of head modules, each having a plurality of nozzles, whether the deviation exists or not is determined for each of the head modules.

15. The nozzle operating situation checking method for inkjet printing apparatus according to claim 1, wherein, when the printing head includes a plurality of head modules, each having a plurality of nozzles, whether the missing nozzle exists or not is determined for each of the head modules.

16. A nozzle operating situation checking program for inkjet printing apparatus which perform printing by dispensing ink droplets from a printing head having a plurality of nozzles arranged in a transverse direction of a printing medium perpendicular to a transport direction of the printing medium, the program comprising the processes of:

printing a grid-shaped testing chart, while transporting the printing medium, to print first line segments over a predetermined distance in the transport direction by dispensing ink droplets from each one of a predetermined number of nozzles located in positions separated in the transverse direction, to print second line segments in the transverse direction by dispensing ink droplets also from the predetermined number of nozzles only when first dispensing ink droplets from the each one nozzle, and when the predetermined distance is reached, to switch to a next nozzle adjoining the each one nozzle in the transverse direction to print the first line segments and the second line segments;

reading the testing chart downstream of the printing head while maintaining transportation of the printing medium;

extracting grid boxes through image processing of image data of the testing chart;

deriving width sizes in the transverse direction from the respective boxes extracted, and deriving a standard width from the width sizes;

detecting a box having a width size equal to or larger than a corrected standard width by comparing the width sizes of the respective boxes with the corrected standard width which is obtained by multiplying the standard width by a predetermined coefficient; and determining that a missing nozzle exists upon detection of the box having a width size equal to or larger than the corrected standard width;

the program causing a controller which controls operation of the inkjet printing apparatus to execute the above processes.

17. The nozzle operating situation checking program for inkjet printing apparatus according to claim 16, further comprising a process of determining that a deviation exists when a discrepancy results from a comparison between the number of boxes extracted in the box extracting process and the number of boxes extracted from the grid-shaped testing chart in time of a normal nozzle operating situation.

* * * * *